US008484797B2

(12) United States Patent
Yoo

(10) Patent No.: US 8,484,797 B2
(45) Date of Patent: Jul. 16, 2013

(54) CLEANER HAVING ADDITIONAL CLEANING APPARATUS

(75) Inventor: Dong-Hun Yoo, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 263 days.

(21) Appl. No.: 12/872,698

(22) Filed: Aug. 31, 2010

(65) Prior Publication Data

US 2011/0191978 A1 Aug. 11, 2011

Related U.S. Application Data

(60) Provisional application No. 61/301,724, filed on Feb. 5, 2010.

(30) Foreign Application Priority Data

Mar. 18, 2010 (KR) ..... 2010-0024257

(51) Int. Cl.
*A47L 9/10* (2006.01)

(52) U.S. Cl.
USPC ..... 15/328; 15/246.2; 15/339

(58) Field of Classification Search
USPC ..... 15/339, 323, 331, 334, 352, 344, 15/329, 246.2, 328; 55/DIG. 3, 428, 429, 55/430, 432, 433; 96/405, 408
See application file for complete search history.

(56) References Cited

U.S. PATENT DOCUMENTS 1,785,873 A * 12/1930 Muller ..... 15/246
6,122,796 A * 9/2000 Downham et al. ..... 15/328

FOREIGN PATENT DOCUMENTS

DE 102008007985 8/2009
JP 2004283322 10/2004

OTHER PUBLICATIONS

Search report for corresponding patent application in Great Britain No. GB1021387.4.

* cited by examiner

*Primary Examiner* — Mark Spisich
*Assistant Examiner* — Andrew A Horton
(74) *Attorney, Agent, or Firm* — Ohlandt, Greeley, Ruggiero & Perle, LLP.

(57) ABSTRACT

A cleaner which removes dirt from an additional cleaning apparatus automatically is provided. The cleaner includes a cleaning apparatus which is removably mounted in the cleaner and is dismounted from the cleaner to perform an additional cleaning operation, and includes a housing to store dirt therein, an outlet through which the dirt stored in the housing is discharged, and a movable cover movable between a closing position to close the outlet and an opening position to open the outlet, a receiving unit for receiving the cleaning apparatus, a conversion unit for converting the movable cover of the cleaning apparatus from the closing position to the opening position, a suction unit for drawing in dirt from a cleaning surface along with air, and a dust-collector which is fluidly connected to the suction unit and the cleaning apparatus to separate dirt from air.

16 Claims, 10 Drawing Sheets

CLEANER HAVING ADDITIONAL CLEANING APPARATUS

CROSS-REFERENCE TO RELATED APPLICATIONS

This application claims the benefit under 35 U.S.C. §119 (e) from U.S. Provisional Application No. 61/301,724, filed on Feb. 5, 2010, and claims the benefit under 35 U.S.C. §119(a) from Korean Patent Application No. 2010-0024257, filed on Mar. 18, 2010 at the Korea Intellectual Property Office, the disclosures of each of which are incorporated herein by reference in their entireties.

BACKGROUND OF THE INVENTION

1. Field of the Invention

The present disclosure relates generally to a cleaner, and more particularly, to a cleaner having an additional cleaning apparatus.

2. Description of the Related Art

In general, a cleaner draws in dirt from a cleaning surface along with ambient air and then collects dirt using a dust-collector. However, since it is difficult to clean every place using a cleaner only, an additional cleaning apparatus may be required. For example, the additional cleaning apparatus can be designed to be able to remove dust, pet's fur or lint of a cloth by using static electricity or brushes. The additional cleaning apparatus can be removably mounted in the body of the cleaner so that it can be removed from the cleaner body and used separately according to the needs of the user.

Once the additional cleaning apparatus has been used, it is necessary to empty the additional cleaning apparatus of its contents such as dust, fur, or lint. However, if the additional cleaning apparatus is emptied manually by a user, the contents such as dust, fur, or lint may be dropped down, contaminating the surrounding area and requiring the user to re-clean the area. Accordingly, there is a need for a method for removing dust, pets' fur, or lint of a cloth from the additional cleaning apparatus automatically, to improve the user's convenience.

SUMMARY OF THE INVENTION

Embodiments of the present disclosure have been developed in order to substantially solve the above and other problems associated with the conventional arrangement and provide the objectives listed below. An aspect of embodiments of the present disclosure is to provide a cleaner which can remove dirt from an additional cleaning apparatus automatically.

The foregoing and other objects and advantages are substantially realized by providing a cleaner including: a cleaning apparatus which is removably mounted in the cleaner and is dismounted from the cleaner to perform an additional cleaning operation, the cleaning apparatus including a housing to store dirt therein, an outlet through which the dirt stored in the housing is discharged, and a movable cover movable between a closing position to close the outlet and an opening position to open the outlet; a receiving unit for receiving the cleaning apparatus; a conversion unit for converting the movable cover of the cleaning apparatus from the closing position to the opening position if the cleaning apparatus is mounted in the receiving unit; a suction unit for drawing in dirt from a cleaning surface along with air; and a dust-collector which is fluidly connected to the suction unit and the cleaning apparatus to separate dirt from air.

The conversion unit may include a protrusion disposed on the movable cover; and a slot disposed on the receiving unit to correspond to the protrusion, and the protrusion may move along the slot when the cleaning apparatus is being mounted in the receiving unit such that the movable cover is converted from the closing position into the opening position.

The movable cover may be elastically biased toward the closing position.

The movable cover may be disposed on a leading end of the housing in a mounting direction.

The cleaning apparatus may further include a fixed cover which is disposed on a leading end of the housing in a mounting direction, and the movable cover may be rotated about a rotary shaft disposed on the fixed cover.

The fixed cover and the movable cover may have a hemispherical shape.

The cleaner may further include a duct for connecting the receiving unit and the dust-collector to each other.

The cleaner may further include a valve which is movable between a first position to block a current in the duct and a second position to allow a current in the duct to flow.

The valve may be elastically biased toward the first position.

The cleaner may further include a switch for controlling an operation of the valve.

The cleaning apparatus may further include a rotary plate on which a first brush is disposed; and a second brush and a third brush which are disposed on left and right sides of the housing with respect to the rotary plate so as to interfere with the first brush.

The second brush and the third brush may be inclined inward the housing.

The cleaning apparatus may further include a blade which protrudes from a center of the rotary plate to limit a rotation angle of the rotary plate.

The cleaning apparatus may further include a filter through which air is passed but dirt is not passed.

The foregoing and other objects and advantages are also substantially realized by providing a cleaning apparatus which is removably mounted in a cleaner and is dismounted from the cleaner to perform an additional cleaning operation, the cleaning apparatus including: a housing which forms an exterior of the cleaning apparatus and stores dirt therein, an outlet through which the dirt stored in the housing is discharged, and a movable cover which is movable between a closing position to close the outlet and an opening position to open the outlet, wherein, if the cleaning apparatus is dismounted from the cleaner, the movable cover moves to the closing position to prevent the dirt stored in the housing from being discharged externally, and, if the cleaning apparatus is mounted in the cleaner, the movable cover moves to the opening position such that the cleaning apparatus is fluidly connected to a dust-collector of the cleaner.

BRIEF DESCRIPTION OF THE DRAWINGS

The above aspects and features of embodiments of the present disclosure will become more apparent by describing certain exemplary embodiments of the present disclosure with reference to the accompanying drawings, in which.

Throughout the drawings, like reference numerals will be understood to refer to like parts, components and structures.

DETAILED DESCRIPTION OF AN EXEMPLARY EMBODIMENT

Figure 1:
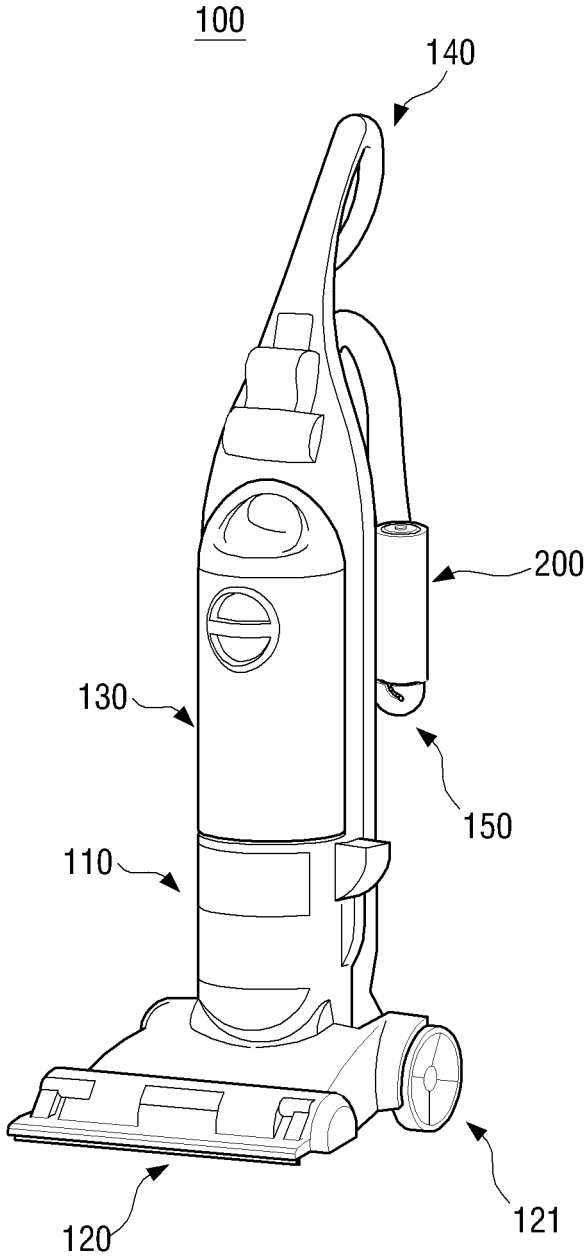
FIG. 1 is a perspective view illustrating a cleaner having an additional cleaning apparatus according to an exemplary embodiment of the present disclosure.

Exemplary embodiments of the present disclosure will now be described in detail with reference to the annexed drawings. In the drawings, the same elements are denoted by the same reference numerals throughout the drawings. In the following description, detailed descriptions of known functions and configurations incorporated herein have been omitted for conciseness and clarity.

FIG. 1 is a perspective view illustrating a cleaner 100 having an additional cleaning apparatus 200 according to an exemplary embodiment of the present disclosure. The cleaner 100 may be a typical vacuum cleaner.

A motor (not shown) is mounted in a cleaner body 110 and provides a suction force for drawing in dirt from a cleaning surface. The motor may provide a suction force for sucking dirt stored in the additional cleaning apparatus 200 as will be explained below.

A suction unit 120 is disposed on a lower portion of the cleaner body 110 to draw in dirt from the cleaning surface along with ambient air. Although an up-right type cleaner having the suction unit 120 integrally formed with the cleaner body 110 is illustrated in FIG. 1, the present disclosure may be applied to a canister type cleaner having the suction unit 120 that can be separated from the cleaner body 110.

A pair of wheels 121 is disposed at the lower portion of the cleaner body 110 to allow a user to move the cleaner 100 with ease.

A dust-collector 130 is mounted in the cleaner body 110 and is fluidly connected with the suction unit 120 to separate dirt and air drawn in through the suction unit 120 from each other. Also, the dust-collector 130 is fluidly connected with the additional cleaning apparatus 200 to separate dirt and air drawn in through the additional cleaning apparatus 200 from each other. The dirt separated from the air in the dust-collector 130 is stored in a dirt receptacle (not shown) and the air is discharged to the outside. The dust-collector 130 may be a cyclone dust-collector which separates dirt from air using a centrifugal force.

A handle 140 is formed on an upper portion of the cleaner body 110 such that the user grips the handle 140 when cleaning.

The additional cleaning apparatus 200 may be mounted in a receiving unit 150 which is disposed on a side surface of the cleaner body 110. FIG. 1 illustrates the additional cleaning apparatus 200 mounted in the receiving unit 150 of the cleaner 100. The user dismounts the additional cleaning apparatus 200 from the receiving unit 150 and then performs an additional cleaning operation other than a cleaning operation performed using the suction unit 120. The additional cleaning operation may be an operation of removing dust, fur of a pet, or lint of a cloth using static electricity or a brush.

Figure 2A:
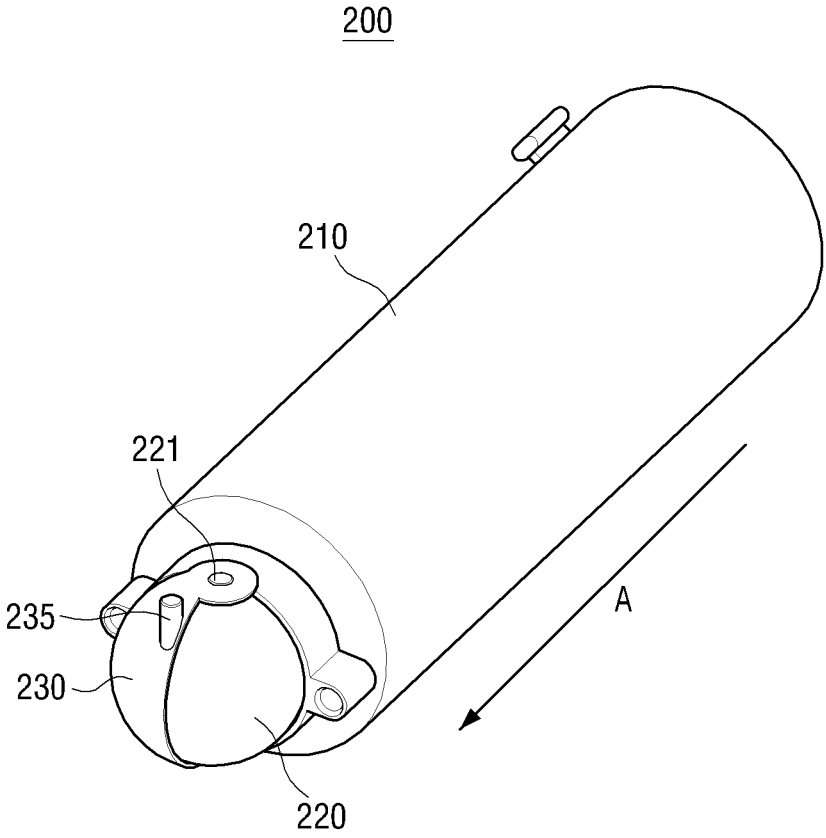
FIGS. 2A and 2B are perspective views illustrating the additional cleaning apparatus of FIG. 1.
Figure 2B:
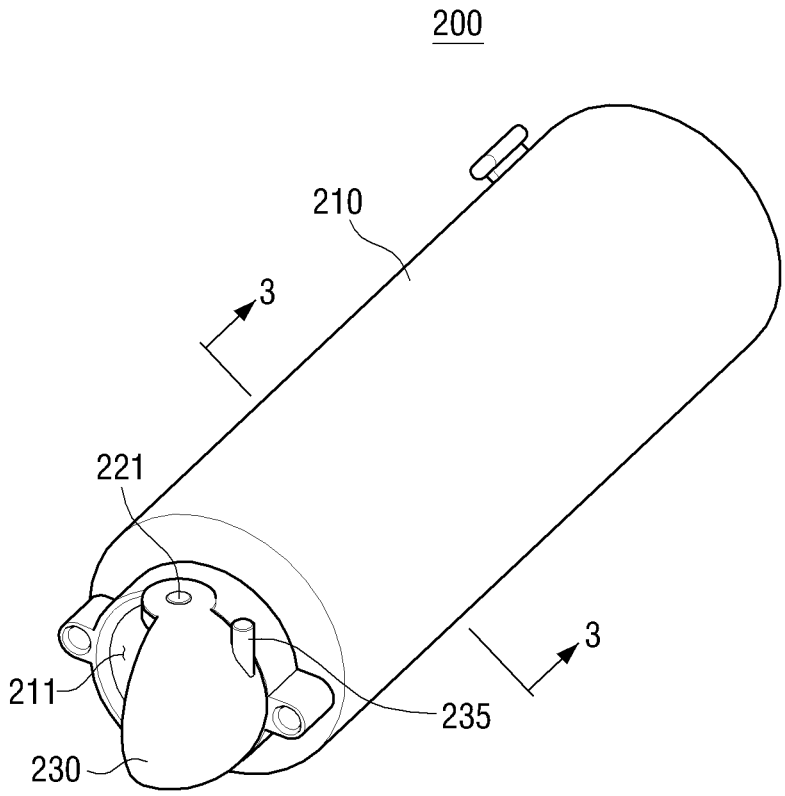

FIGS. 2A and 2B are perspective views illustrating the additional cleaning apparatus of FIG. 1. FIG. 2A illustrates the additional cleaning apparatus 200 when it is dismounted from the receiving unit 150 of the cleaner 100, and FIG. 2B illustrates the additional cleaning apparatus 200 when it is mounted in the receiving unit 150 of the cleaner 100. The arrow A in FIG. 2A indicates a direction in which the additional cleaning apparatus 200 is mounted in the receiving unit 150 of the cleaner 100.

A housing 210 forms an exterior of the additional cleaning apparatus 200. The housing 210 stores therein dirt such as dust, pets' fur or lint of a cloth, which the additional cleaning apparatus 200 collects after the additional cleaning operation. An outlet 211 (see FIG. 2B) is formed on one end of the housing 210 and the dirt stored in the housing 210 is discharged to the outside of the additional cleaning apparatus 200 through the outlet 211.

A fixed cover 220 is disposed at one end of the housing 210 (that is, at the leading end of the housing 210 in the mounting direction), which faces the receiving unit 150 of the cleaner 100. The fixed cover 220 closes part of the outlet 211 formed on one end of the housing 210 to prevent the dirt stored in the housing 210 from being discharged to the outside. Although the fixed cover 220 is illustrated as a separate element in this embodiment, the fixed cover 220 may be integrally formed with the housing 210. In this case, the fixed cover 220 is a part of the housing 210.

A movable cover 230 is formed at one end of the housing 210 (that is, at the leading end of the housing 210 in the mounting direction), which faces the receiving unit 150 of the cleaner, similarly to the fixed cover 220. The movable cover 230 may be movable between a closing position to close the outlet 211 formed on the one end of the housing 210 as shown in FIG. 2A and an opening position to open the outlet 211 as shown in FIG. 2B.

According to an exemplary embodiment illustrated in FIGS. 2A and 2B, the movable cover 230 may be rotated about a rotary shaft 221, which is formed on the fixed cover 220. That is, if the additional cleaning apparatus 200 is dismounted from the receiving unit 150 as shown in FIG. 2A, the movable cover 230 normally closes the one end of the housing 210 in association with the fixed cover 220 (that is, moves to the closing position), thereby preventing the dirt stored in the housing 210 from being discharged to the outside. If the additional cleaning apparatus 200 is mounted in the receiving unit 150, the movable cover 230 is rotated to be placed over the fixed cover 220 (that is, moves to the opening position), thereby opening the one end of the housing 210. Accordingly, the additional cleaning apparatus 200 is fluidly connected to the dust-collector 130.

An elastic member (not shown) is disposed on the rotary shaft 221 of the fixed cover 220 to elastically bias the movable cover 230 toward the closing position. Accordingly, if the additional cleaning apparatus 200 is dismounted from the receiving unit 150 as shown in FIG. 2A, the movable cover 230 moves to the closing position due to the presence of the elastic member, thereby closing the one end of the housing 210. The way of opening and closing the movable cover 20 will be explained in detail below.

According to an exemplary embodiment of the present disclosure, the fixed cover 220 and the movable cover 230 have a hemispherical shape. However, the shapes of the fixed cover 220 and the movable cover 230 are changeable only if the fixed cover 220 and the movable cover 230 can open and close the one end of the housing 210. For example, the fixed cover 220 and the movable cover 230 may have flat panel shapes such that the movable cover 230 slides along a guide recess formed on the fixed cover 220.

A rotary plate 250 (see FIGS. 3A to 3C) is rotatably disposed in the housing 210. A first brush 251 is disposed on an area of the rotary plate 250 that is exposed to the outside. If the user rubs a cleaning surface with the additional cleaning apparatus 200, the rotary plate 250 is rotated and the dirt on the cleaning surface is attached to the first brush 251.

Figure 3A:
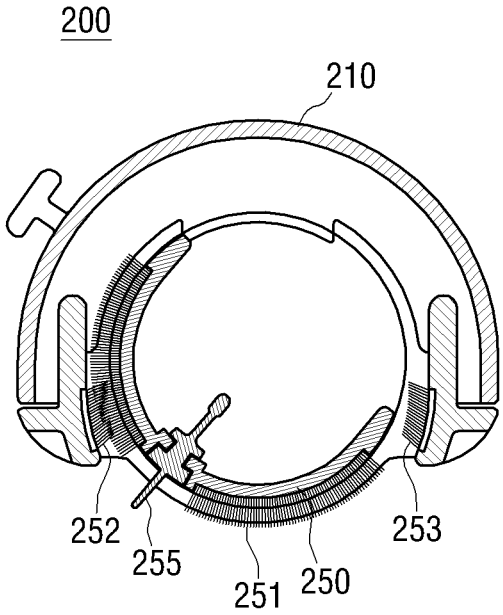
FIGS. 3A to 3C are cross-section views illustrating the additional cleaning apparatus of FIG. 1, taken along line 3-3 of FIG. 2B.
Figure 3B:
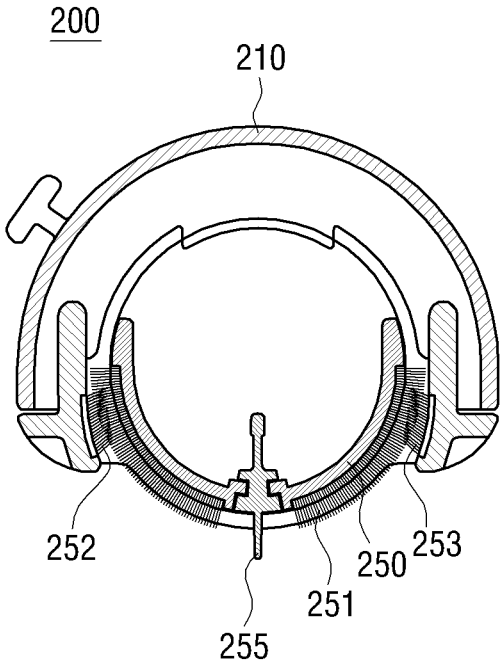
Figure 3C:
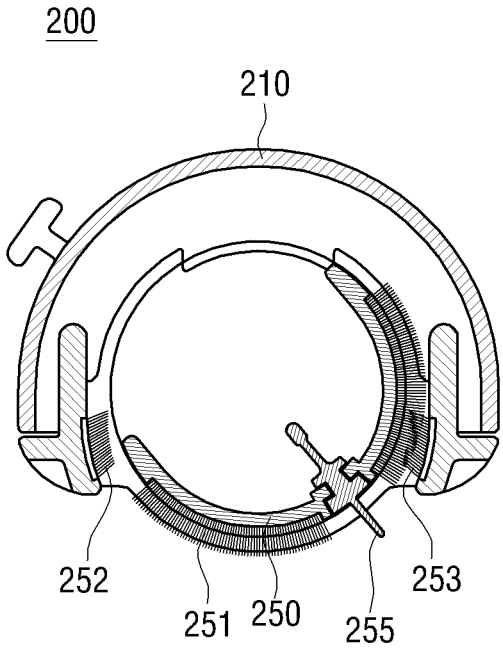

A second brush 252 and a third brush 253 are disposed on the left and right sides of the housing 210 with respect to the rotary plate 250, respectively, so as to interfere with the first brush 251. As shown in FIGS. 3A to 3C, the second and the third brushes 252 and 253 may be inclined toward the inside of the housing 210. The dirt attached to the first brush 251 is detached from the first brush 251 by the second and the third brush 252 and 253 and is then stored in the housing 210.

FIGS. 3A to 3C are cross-section views illustrating the additional cleaning apparatus 200 of FIG. 1. A cleaning operation using the additional cleaning apparatus 200 will be explained with reference to FIGS. 3A to 3C.

The user dismounts the additional cleaning apparatus 200 from the receiving unit 150, resulting in the movable cover 230 moving to the closing position to close the one end of the housing 210. The user then rubs a surface on which dust is piled, a pet or a cloth with the additional cleaning apparatus 200 by moving the additional cleaning apparatus 200 in the direction of arrow B in FIG. 3A. Consequently, the rotary plate 250 is rotated as shown in FIGS. 3A to 3C. If the additional cleaning apparatus 200 moves from the right to the left in a state shown in FIG. 3A, the rotary plate 250 is rotated in a counter-clockwise direction (that is, moves from a position of FIG. 3A to a position of FIG. 3C). If the additional cleaning apparatus 200 moves from the left to the right in a state shown in FIG. 3C, the rotary plate 250 is rotated in a clockwise direction (that is, moves from the position of FIG. 3C to the position FIG. 3A). Since the first brush 251 is disposed on the rotary plate 250, dust or dirt such as pets' fur and lint of a cloth are attached to the first brush 251 as the rotary plate 250 is rotated.

As the rotary plate 250 is rotated, the first brush 251 is interfered by the second and the third brushes 252 and 253 so that the dirt attached to the first brush 241 is detached from the first brush 251 and stored in the housing 210. That is, if the rotary plate 250 is rotated from FIG. 3B to FIG. 3A, the first brush 251 is not much interfered with the second brush 252 due to the inclination direction of the second brush 252 so that the dirt attached to the first brush 251 is not detached. However, if the rotary plate 250 is rotated from FIGS. 3A to 3B, the first brush 251 is greatly interfered with the second brush 252 so that the dirt attached to the first brush 251 is detached and stored in the housing 210. If the rotary plate 250 is rotated from FIG. 3B to FIG. 3C, the first brush 251 is not much interfered with the third brush 253 due to the inclination direction of the third brush 253 so that the dirt attached to the first brush 251 is not detached. However, if the rotary plate 250 is rotated from FIGS. 3C to 3B, the first brush 251 is greatly interfered with the third brush 253 so that the dirt attached to the first brush 251 is detached and stored in the housing 210.

A blade 255 protrudes from the center of the rotary plate 250 to limit the rotation angle of the rotary plate 250. Also, the blade 255 is rubbed against a pet or a cloth, thereby helping the pet's fur or lint of the cloth to be attached to the first brush 251. The blade 255 may be made of flexible rubber material.

Figure 4A:
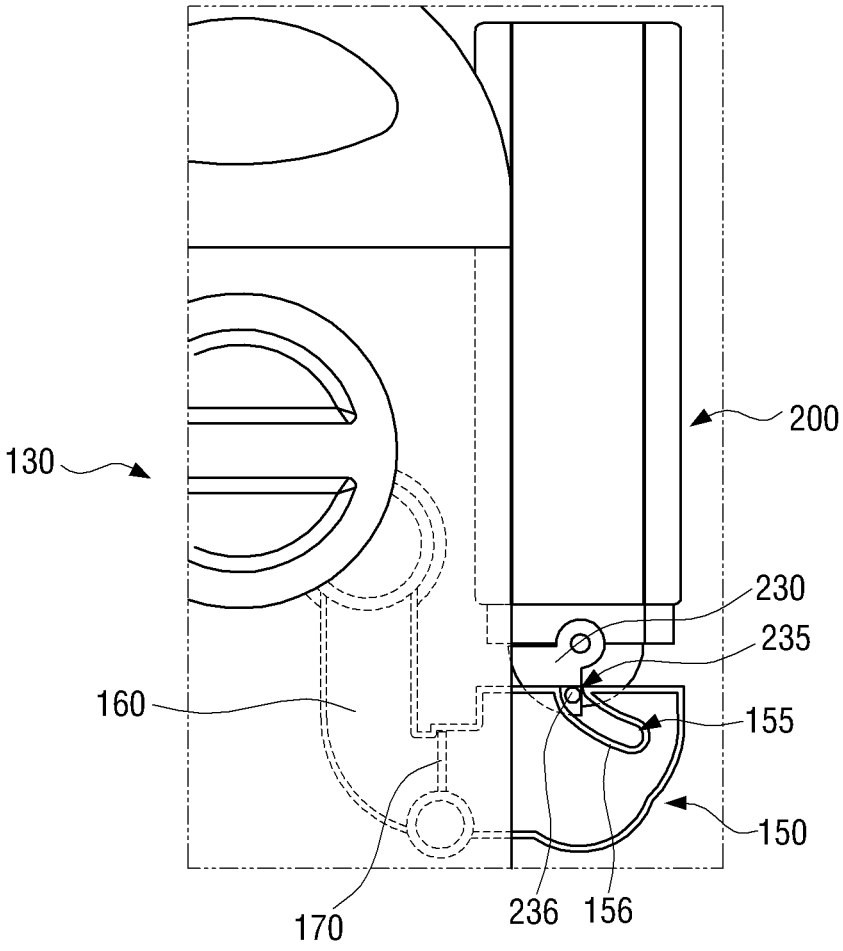
FIGS. 4A and 4B are views illustrating a process for mounting the additional cleaning apparatus of FIG. 1 in a receiving unit of the cleaner.
Figure 4B:
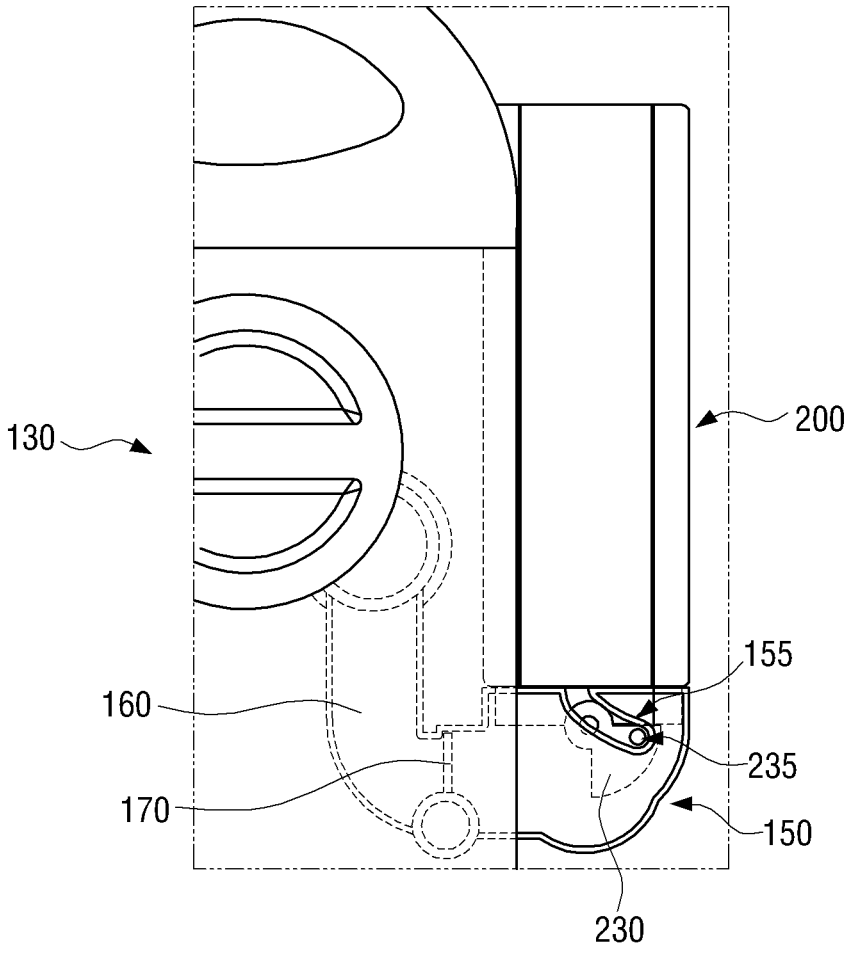

FIGS. 4A and 4B illustrate a process that the additional cleaning apparatus 200 is mounted in the receiving unit 150 of the cleaner 100. In this case, the movable cover 230 is converted from the closing position into the opening position by conversion units 155 and 235.

In this embodiment, conversion unit 155 comprises a slot 156, while conversion unit 235 comprises a protrusion 236. The slot 156 is formed in the receiving unit 150 of the cleaner 100 and the protrusion 236 corresponding to the slot 156 is formed on the movable cover 230 of the additional cleaning apparatus 200. As shown in FIG. 4A, an opening of the slot 156 is located at a position corresponding to a position of the protrusion 236 when the movable cover 230 is in the closing position. Also, the slot 156 is formed so as to move the movable cover 230 to the opening position. That is, according to an exemplary embodiment of the present disclosure, the slot 156 is bent toward the right side as shown in FIG. 4A. Accordingly, when the additional cleaning apparatus 200 is being mounted in the receiving unit 150, the protrusion 236 slides along the slot 156 so that the movable cover 230 is rotated. If the additional cleaning apparatus 200 is completely mounted in the receiving unit 150 of the cleaner 100, the movable cover 230 is completely rotated and placed over the fixed cover 220 as shown in FIG. 4B, and thus one end of the additional cleaning apparatus 200 is opened.

In this embodiment, the movable cover 230 is converted from the closing position to the opening position by the slot 156 and the protrusion 236. However, this is merely an example. It should be understood that the structure of the conversion units 155 and 235 may be changeable provided that they can convert the position of the movable cover 230 between the open and closed positions by the mounting and dismounting of the second cleaning apparatus 200 to the receiving unit 150.

A duct 160 connects the receiving unit 150 and the dust-collector 130 to each other. According to an exemplary embodiment of the present disclosure, the duct 160 has one end connected to an inlet 165 of the dust-collector 130 (see FIGS. 5A and 5B). The inlet 165 of the dust-collector 130 is connected to the suction unit 120. Accordingly, since the dust-collector 130 are fluidly connected to both the suction unit 120 and the additional cleaning apparatus 200, the dust-collector 130 may be used to separate dirt from air which is drawn in through the suction unit 120 and drawn in from the additional cleaning apparatus 200.

In this case, since the outlet 211 of the additional cleaning apparatus 200 is closed when the additional cleaning apparatus is dismounted from the receiving unit 150, but the outlet 211 is automatically opened when the additional cleaning apparatus 200 is mounted in the receiving unit 150, the additional cleaning apparatus 200 and the dust-collector 130 can be fluidly connected to each other through the duct 160. Accordingly, the dirt such as dust, pet's fur, or lint stored in the additional cleaning apparatus 200 may be removed automatically by the dust-collector 130 of the cleaner 100.

A valve 170 is disposed in the duct 160 and is movable between a first position to block a current flowing in the duct 160 and a second position to allow a current in the duct to flow. The valve 170 will be described in detail below with reference to FIGS. 5A and 5B.

Figure 5A:
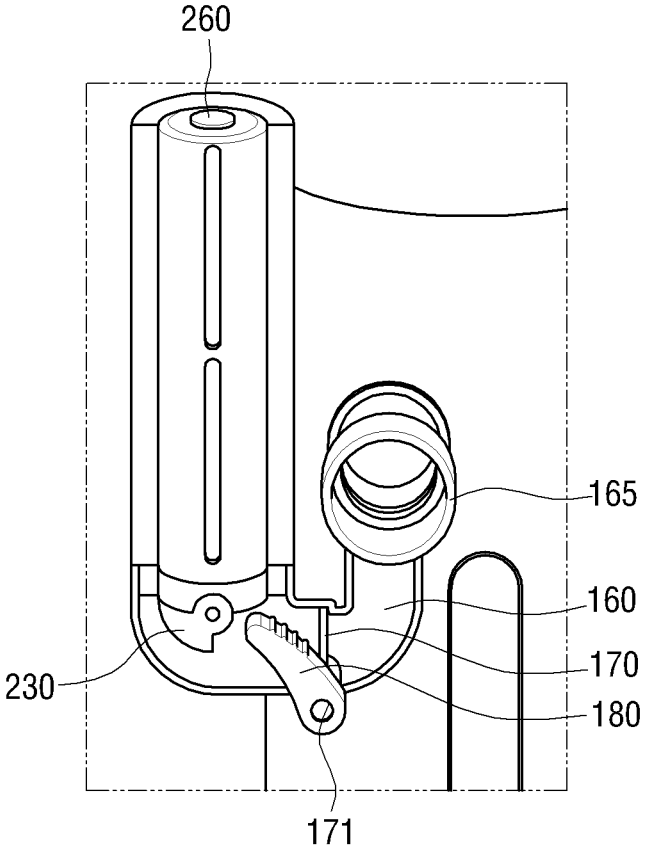
FIGS. 5A and 5B are views illustrating the duct of FIG. 4A from which a part is cut away.
Figure 5B:
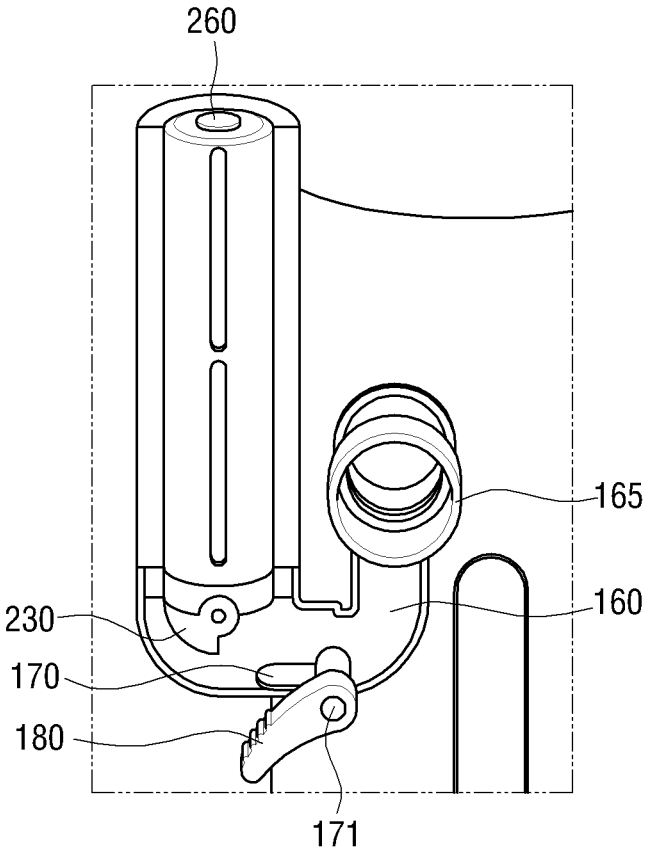

FIGS. 5A and 5B are views illustrating the duct 160 of FIG. 4A from which a part is cut away and seen from the rear side of the cleaner 100.

The valve 170 is rotated about a valve rotary shaft 171. FIG. 5A illustrates the valve 170 which is placed in the first position to block the current flowing in the duct 160, and FIG. 5B illustrate the valve 170 which is placed in the second position to allow the current in the duct to flow.

A switch 180 controls the operation of the valve 170. The switch 180 is exposed to the outside from the rear surface of the cleaner 100 so that a user can manipulate the switch 180. According to an exemplary embodiment of the present disclosure, the switch 180 is operated in association with the valve 170 disposed in the duct 160. That is, the switch 180 may be rotated about the valve rotary shaft 171 along with the valve 170. Accordingly, as the switch 180 is rotated, the valve 170 disposed in the duct 160 is rotated along with the switch 180 and thus is moved between the first position and the second position.

An elastic member (not shown) is formed on the valve rotary shaft 171 to elastically bias the valve 170 toward the first position to block the current in the duct 160. Accordingly, the valve 170 remains in the first position due to the elastic member when the additional cleaning apparatus 200 is not in use. In this case, since a suction force is not applied to the additional cleaning apparatus 200 when the cleaner 100 performs a cleaning operation using the suction unit 120, unnecessary power consumption can be prevented. However, if the additional cleaning apparatus 200 is full of dirt, the switch 180 is pressed by the user such that the valve 170 is moved to the second position as shown in FIG. 5B and thus the suction force is applied to the additional cleaning apparatus 200.

As described above, if the additional cleaning apparatus 200 is mounted in the receiving unit 150, movable cover 230 of the additional cleaning apparatus 200 is automatically opened. Accordingly, if the valve 170 is converted from the first position (FIG. 5A) into the second position (FIG. 5B) by the user pressing the switch 180, the additional cleaning apparatus 200 and the dust-collector 130 are fluidly connected to each other. If a suction force is generated by the motor mounted in the cleaner body 110, a current flowing from the additional cleaning apparatus 200 toward the dust-collector 130 is generated. Accordingly, the dirt stored in the additional cleaning apparatus 200 flows into the dust-collector 130 through the duct 160 and thus the additional cleaning apparatus 200 is emptied. The dust-collector 130 separates the dirt stored in the additional cleaning apparatus 200 and stores the dirt in a dirt receptacle (not shown). As such, the dirt can be removed from the additional cleaning apparatus 200 automatically.

Since air may pass between the first brush 251 and the second and the third brushes 252 and 253 even if the current flowing toward the dust-collector 130 is formed in the additional cleaning apparatus 200, vacuum does not occur inside the additional cleaning apparatus 200.

In order to make sure that vacuum does not occur inside the additional cleaning apparatus 200, a filter 260 through which only air is passed (see FIGS. 5A and 5B) may be disposed on an upper portion of the additional cleaning apparatus 200. Since the filter does not pass the dirt, the dirt stored in the additional cleaning apparatus 200 is not discharged to the outside.

The additional cleaning apparatus 200 described in the aforementioned embodiments removes pets' furs or lint of a cloth using the brushes 251-253 disposed on the rotary plate 250. However, this is merely an example and a different type additional cleaning apparatus may be realized only if it can store dirt therein.

Also, in the aforementioned embodiments, the user opens and closes the valve 170 manually. However, the valve 170 may be designed to be opened automatically when the additional cleaning apparatus 200 is mounted in the receiving unit 150.

Hereinafter, an operation of the cleaner 100 according to an exemplary embodiment will be explained.

As shown in FIG. 1, the user grips the handle 140 of the cleaner 100 and cleans a cleaning surface. More specifically, dirt is drawn in through the suction unit 120 along with air from the cleaning surface and is then separated from the air in the dust-collector 130. The separated dirt is stored in the dirt receptacle, whereas the air is discharged to the outside of the cleaner 100.

In the case of dirt that cannot be removed using the suction unit 120 and thus requires an additional cleaning operation, such as pets' fur or lint of a cloth, the user dismounts the additional cleaning apparatus 200 from the receiving unit 150 of the cleaner 100 to perform the additional cleaning operation. Here, dismounting the additional cleaning apparatus 200 from the receiving unit 150 results in the movable cover 230 of the additional cleaning apparatus 200 automatically closing. After the additional cleaning operation is completed, the dirt such as fur and lint is stored in the additional cleaning apparatus 200. Since the outlet 211 of the additional cleaning apparatus 200 is closed by the fixed cover 220 and the movable cover 230, the dirt is not discharged from the additional cleaning apparatus 200.

If the user mounts the additional cleaning apparatus 200 in the receiving unit 150 of the cleaner 100, the movable cover 230 moves due to the slot 156 formed on the receiving unit 150 and the protrusion 236 formed on the formed on the movable cover 230, thereby opening the outlet 211 of the additional cleaning apparatus 200.

The user turns on the cleaner 100 to generate a suction force. Then, if the valve 170 is switched to the second position to allow the current in the duct 160 to flow by pressing the switch 180 (see FIG. 5B), the dust-collector 130 and the additional cleaning apparatus 200 are fluidly connected to each other through the duct 160. Accordingly, a current flowing from the additional cleaning apparatus 200 toward the dust-collector 130 is formed so that the dirt stored in the additional cleaning apparatus 200 flows into the dust-collector 130, is separated from air in the dust-collector 130, and is stored in the dirt receptacle. As described above, since the additional cleaning apparatus 200 is emptied of the dirt automatically, user's convenience is improved.

Of course, according to user's necessity, when the additional cleaning apparatus 200 is dismounted from the cleaner 100, the user may empty the additional cleaning apparatus 200 manually by moving the movable cover 230 to the opening position.

The foregoing embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A cleaner comprising:

a cleaning apparatus that is removably mounted in the cleaner and is dismounted from the cleaner to perform an additional cleaning operation, the cleaning apparatus comprising a housing to store dirt therein, an outlet through which the dirt stored in the housing is discharged, and a movable cover movable between a closing position to close the outlet and an opening position to open the outlet;

a receiving unit for receiving the cleaning apparatus;

a conversion unit for converting the movable cover of the cleaning apparatus from the closing position to the opening position if the cleaning apparatus is mounted in the receiving unit;

a suction unit for drawing in dirt from a cleaning surface along with air; and a dust-collector which is fluidly connected to the suction unit and the cleaning apparatus to separate dirt from air, wherein the conversion unit comprises a protrusion disposed on the movable cover; and a slot disposed on the receiving unit to correspond to the protrusion, and wherein the protrusion moves along the slot when the cleaning apparatus is being mounted in the receiving unit such that the movable cover is converted from the closing position into the opening position.

2. The cleaner as claimed in claim 1, wherein the movable cover is elastically biased toward the closing position.

3. The cleaner as claimed in claim 1, wherein the movable cover is disposed on a leading end of the housing in a mounting direction.

4. The cleaner as claimed in claim 1, wherein the cleaning apparatus further comprises a fixed cover which is disposed on a leading end of the housing in a mounting direction, and the movable cover is rotated about a rotary shaft disposed on the fixed cover.

5. The cleaner as claimed in claim 4, wherein the fixed cover and the movable cover each have a hemispherical shape.

6. The cleaner as claimed in claim 1, further comprising a duct for connecting the receiving unit and the dust-collector to each other.

7. The cleaner as claimed in claim 6, further comprising a valve which is movable between a first position to block a current in the duct and a second position to allow the current in the duct to flow.

8. The cleaner as claimed in claim 7, wherein the valve is elastically biased toward the first position.

9. The cleaner as claimed in claim 7, further comprising a switch for controlling an operation of the valve.

10. The cleaner as claimed in claim 1, wherein the cleaning apparatus further comprises a rotary plate on which a first brush is disposed; and a second brush and a third brush which are disposed on left and right sides of the housing with respect to the rotary plate so as to interfere with the first brush.

11. The cleaner as claimed in claim 10, wherein the second brush and the third brush are inclined inward the housing.

12. The cleaner as claimed in claim 10, wherein the cleaning apparatus further comprises a blade which protrudes from a center of the rotary plate to limit a rotation angle of the rotary plate.

13. The cleaner as claimed in claim 1, wherein the cleaning apparatus further comprises a filter through which air is passed but dirt is not passed.

14. A cleaner comprising:

a cleaning apparatus that is removably mounted in the cleaner and is dismounted from the cleaner to perform an additional cleaning operation, the cleaning apparatus comprising a housing to store dirt therein, an outlet through which the dirt stored in the housing is discharged, and a movable cover movable between a closing position to close the outlet and an opening position to open the outlet;

a receiving unit for receiving the cleaning apparatus;

a conversion unit for converting the movable cover of the cleaning apparatus from the closing position to the opening position if the cleaning apparatus is mounted in the receiving unit;

a suction unit for drawing in dirt from a cleaning surface along with air; and a dust-collector which is fluidly connected to the suction unit and the cleaning apparatus to separate dirt from air, wherein the cleaning apparatus further comprises a rotary plate on which a first brush is disposed; and a second brush and a third brush which are disposed on left and right sides of the housing with respect to the rotary plate so as to interfere with the first brush.

15. The cleaner as claimed in claim 14, wherein the second brush and the third brush are inclined inward the housing.

16. The cleaner as claimed in claim 14, wherein the cleaning apparatus further comprises a blade which protrudes from a center of the rotary plate to limit a rotation angle of the rotary plate.

* * * * *